United States Patent [19]

Heller

[11] 4,192,288

[45] Mar. 11, 1980

[54] MATERIAL HEATING APPARATUS

[75] Inventor: Anton H. Heller, Levittown, N.Y.

[73] Assignee: Poweray Infrared Corp., Amityville, N.Y.

[21] Appl. No.: 922,779

[22] Filed: Jul. 7, 1978

[51] Int. Cl.[2] ..... E01C 19/45

[52] U.S. Cl. ..... 126/343.5 A

[58] Field of Search ..... 126/343.5 A, 343.5 R, 126/271.2 C, 375, 376, 377, 378, 382, 360 R; 220/68; 432/13

[56] References Cited

U.S. PATENT DOCUMENTS

| | | | |
|---|---|---|---|
| 1,849,581 | 3/1932 | Littleford, Jr. | 126/343.5 A |
| 2,544,153 | 3/1951 | Hall | 126/343.5 A |
| 3,315,659 | 4/1967 | Schmitz | 126/343.5 A |
| 3,577,976 | 5/1971 | Heller | 126/343.5 A |
| 3,661,141 | 5/1972 | Salemink | 126/343.5 A |
| 4,028,527 | 6/1977 | Thagard, Jr. | 126/343.5 A X |
| 4,125,154 | 11/1978 | Franke et al. | 126/343.5 A X |

FOREIGN PATENT DOCUMENTS

| | | | |
|---|---|---|---|
| 1106902 | 5/1961 | Fed. Rep. of Germany | 126/343.5 A |

*Primary Examiner*—Samuel Scott
*Assistant Examiner*—Randall L. Green
*Attorney, Agent, or Firm*—Bauer & Amer

[57] ABSTRACT

A container for maintaining molten material at an elevated temperature below the decomposition temperature of the material is heated utilizing a relatively high temperature infrared source by interposing a heat absorbing means relatively spaced between the heat source and the container for absorbing the infrared radiation from the scurce and for transmitting secondary radiation at a substantially reduced temperature onto the container skin.

17 Claims, 5 Drawing Figures

MATERIAL HEATING APPARATUS

BACKGROUND OF THE INVENTION

The present invention relates to heated containers for retaining a material in a molten state.

Tar, asphalt and like materials are often utilized for roadway pot hole repairs and for other pavement maintenance work, being easily applied in a molten state. Tar pots for maintaining the material in a molten or liquid condition commonly comprise a single shell container to which heat is directly applied in order to heat and melt the tar material therewithin. Inasmuch as the tar is often initially placed into the tar pot in a solid mass for liquification, the heating of the container or tank is generally performed at relatively high temperatures to effect the softening of the tar within an accelerated period of time.

Typically the material is heated by directing a flame from an acetylene torch or propane gas burner or the like onto a particular spot or spots along the outer surface of the container shell. At those spots or areas upon which the flame impinges the shell is highly heated by the flame and this heat is transferred by conduction throughout the remainder of the container shell. Conduction heat losses in the shell, however, cause local temperatures at the points of direct heating to substantially exceed the temperature at locations removed therefrom. The tar adjacent the shell is thus heated through contact therewith and the temperature of the remainder of the tar is elevated as a result of heat transfer throughout the material. It is, of course, recognized that the temperature distribution throughout the tank will be highly non-uniform since the tar immediately adjacent directly heated portions of the shell will be significantly hotter than the material adjacent the remainder of the shell and material located interior of the bounds or walls of the container.

It is well know that tar breaks down or "cokes" under relatively low temperature heating in the region of 550° or 575° F., the decomposition resulting in the formation of hardened chunks of carbonaceous material. The tar is thereby rendered useless for its usual applications as it loses its elasticity and cannot be reliquified by further heating. The initial addition to the tar of foreign substances to enable the tarring material to perform more fully the functions that may be needed—such as in filling cracks in roadways and the like—results in a lowering of the decomposition or "coking" temperature of the tar to approximately 450° F.

As a result, the tar immediately adjacent the heated container shell upon which the flame is directed cooks and breaks down along the interior surface of the container, depositing thereon a carbonaceous residue. These deposits are poor heat conductors and consequently reduce the efficiency of the heat transfer which is relied upon to maintain the bulk of the tar material in the interior of the tar pot in a molten state. The use of high heat thus not only renders unusable at least a portion of the tar material heated but, in addition, significantly reduces the efficiency of the heating operation, necessitating the use of additional fuel to attain and maintain the desired heated condition. The direct impingement of the flame onto the outer surface of the container also serves to fairly rapidly erode and deteriorate the shell. necessitating its frequent replacement.

Recognizing the propensity of the tar material to coke at such relatively low temperatures. Various devices for heating the material has been proposed wherein the flame does not directly impinge upon the container. In U.S. Pat. Nos. 3,315,659 to Schmitz and 3,503,382 to Wollner, a gas burner is utilized to project heated air into heat conducting pipes or ducts immersibly disposed within the tar-holding chamber for maintaining the tar at elevated temperatures. The lack of any disclosed regulating mechanism capable of limiting the temperature of the heated air projected into the pipes or ducts suggests that decomposition of the tar will still occur adjacent thereto. In addition, the piping will clearly be hotter at its connection with the source of heated air than at the exhaust end, resulting in an uneven temperature distribution throughout the piping and therefore within the tar material.

Attempts have also been made in enclosing or encasing the tar material within a multi-walled structure. Such multi-walled structures may include an outer shell and an inner shell between which a fluid such as oil or air may be circulated. When the fluid is heated, it is hoped that the same will impart a more evenly distributed elevated temperature to the tar-holding inner shell to thereby avoid the possibility of coking. U.S. Pat. No. 2,728,336 to Elgeti utilizes a gas burner to project heated air between inner and outer shells. Insulatively disposed sand and granite is provided to prevent excess dissipation of heat from the outer shell. Again, however, the absence of any ability to adequately insure that temperatures will be limited to maintain the inner shell below the decomposition temperature of the tar suggest a high probability of coking about the inner shell. This problem is further compounded by the provision of insulative materials to keep excess heat between the two shells which will have the effect of enabling large amounts of heat to build up within the enclosure thereby further raising the temperature of the inner shell.

Thagard, Jr., in U.S. Pat. No. 4,028,527, teaches the use of thermostatically-controlled electric heating elements embedded within or otherwise in direct communication with the container shell. While this system will apparently provide a fairly constant and regulated shell temperature, the necessity of insuring access to a source of electric potential for operation of the heating elements severely limits the portability of such a unit in a relatively small-scale field use, such as the filling of pot holes or related pavement repair work. In addition, the high cost of electricity renders operation of the Thagard, Jr. apparatus extremely and possibly prohibitively expensive for such typical tar-related repair work.

It is, therefore, the desideratum of the present invention to provide an apparatus for heating a material-holding container to a substantially constant selected temperature below the decomposition temperature of the material by utilizing a source of heat emitting radiation at a relatively high temperature above the decomposition temperature of the material.

Further objects, features and advantages of the present invention will be more fully appreciated by reference to the following detailed description of a presently preferred, but nonetheless illustrative embodiment in conjunction with the present invention when taken in conjunction with the accompanying drawings, wherein.

DETAILED DESCRIPTION OF THE PREFERRED EMBODIMENT

Figure 1:
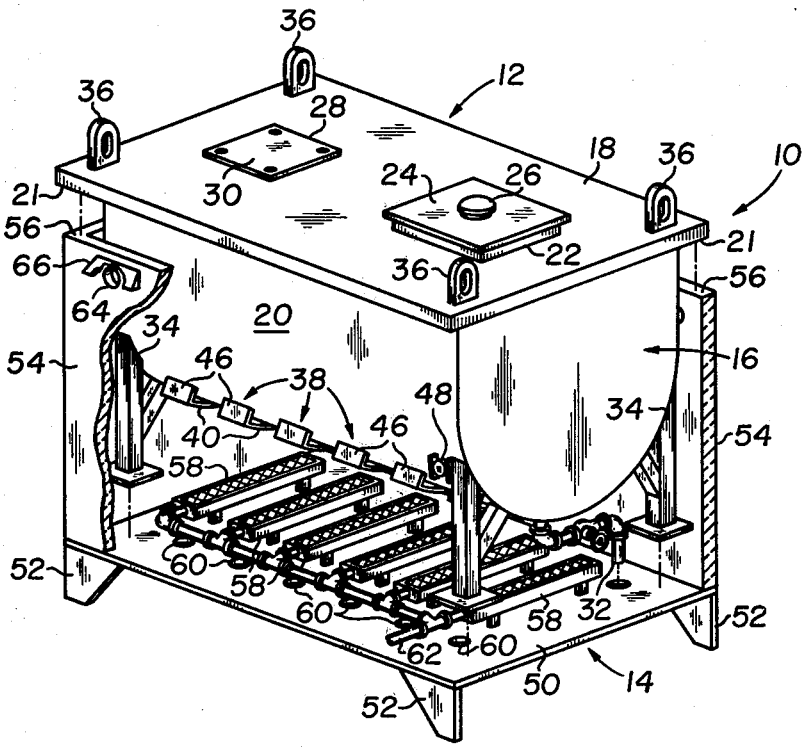
FIG. 1 is a perspective view of an apparatus constructed according to the invention.
Figure 2:
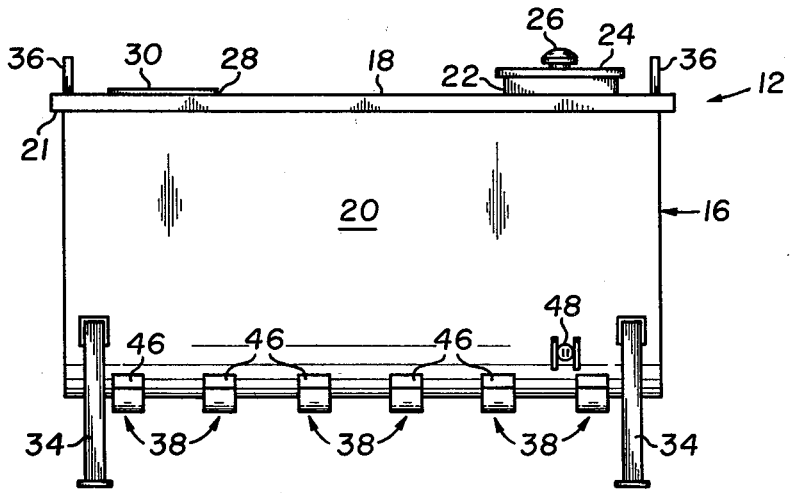
FIG. 2 is a side view of a portion of the apparatus of FIG. 1
Figure 3:
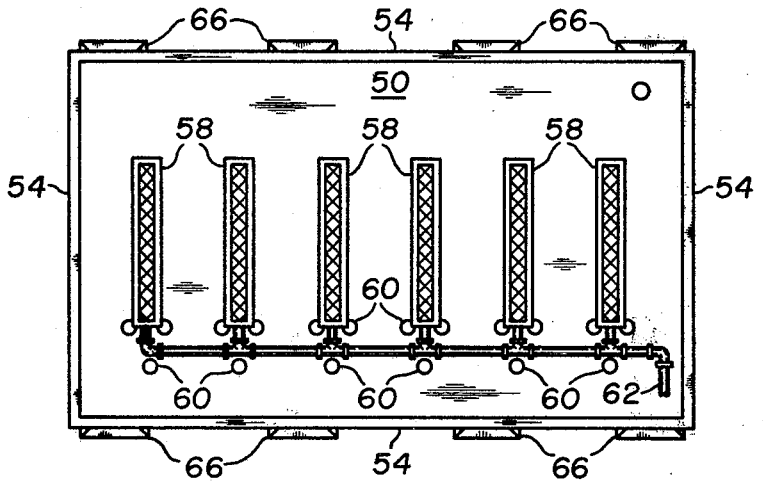
FIG. 3 is a plan view of the heating apparatus of the apparatus of FIG. 1.

Referring now to the drawings, there is shown in FIG. 1 an apparatus, designated generally by the reference numeral 10, for heating and maintaining a flowable material at a predetermined elevated temperature. The apparatus 10 is constructed in accordance with the teachings of the present invention and comprises a material-holding tank 12 supportably positioned on a heating apparatus 14.

It should be understood that the exemplary apparatus 10 soon to be described is particularly directed in utility and design toward a structure for maintaining heated tar or asphalt or the like in a molten condition to facilitate its use in street or pavement repair or in any other use calling for the application of asphalt in a flowable or substantially liquid state. Thus, the terms "tar" and "asphalt" are utilized frequently and interchangeably throughout this specification in referring to the molten or flowable material. It should, however, be clear to those skilled in the art that the present invention is equally applicable to a wide range of uses wherein other materials may be employed. Furthermore, such other uses may by their very nature require or suggest variations in the structural details provided in the apparatus 10 and these changes are deemed to be within the scope of the present disclosure. Hence, the description of the apparatus 10 in terms of its employment in an asphalt heating application is not meant to constitute a limitation on the scope or teachings of the invention.

The material-holding tank or tar pot 12 comprises an essentially closed vessel in the form of an elongated container generally designated 16 for holding an amount of material such as tar in a flowable or liquid state. Typically, the capacity of the container 16 may be approximately 400 gallons. The substantially cradle-shaped container 16 may be formed of relatively thick steel plate as ¼ inch thickness and includes a substantially enclosing cover 18 welded or otherwise secured to or formed integral with an arcuately continuous bottom and side-walls 20. Downwardly depending marginal edges 21 on and peripherally about the cover 18 are adapted to cooperate with the heating apparatus 14 in a manner to be described hereinafter.

The cover 18 includes an inlet port 22 defined therein preferably sized to enable the introduction of liquid rather than solid asphalt into the container 16 and a sealing cap 24 for closing the port 22. The cap 24 may be provided as a hinged door insulated to minimize the heat loss therethrough. A one-way breather valve 26 on the cap 24 enables the release of gases that might tend to build up pressure within the essentially closed container 16 as the material therein is heated.

A second port 28 defined in the cover 18 which is shown covered or closed with a removable cover plate 30 is adapted to receive an optional liquid pump (not shown) for the purpose of pumping liquid asphalt from the container 16. In the absence of the inclusion of such a pump, a valved drain pipe 32 which is provided in the area of the lowest portion of the container wall 20 to enable complete draining of the container 16 may be utilized for dispensing heated asphalt therethrough from the tar pot 12 as required. Legs 34 depend downwardly from the container wall 20 for substantially supporting the weight of the tar pot 12, and transporting loops 36 carried on the cover 18 provide means for grasping the tank 12 to enable the same to be lifted from its position of operational supported engagement on the heating apparatus 14.

Positioned along the bottom or lower portion of the continuous sidewall 20 is an absorber means seen to comprise a plurality of elongated heat absorbing members individually and collectively designated 38 arranged substantially transverse to the direction of the elongation of the container 16. Each absorbing member 38 includes an elongated radiating element or surface 40 spaced from the container wall 20 a selected distance and preferably curved to the approximate contour of the adjacent wall 20 so as to maintain a substantially uniform spacing therefrom along its entire length.

Figure 5:
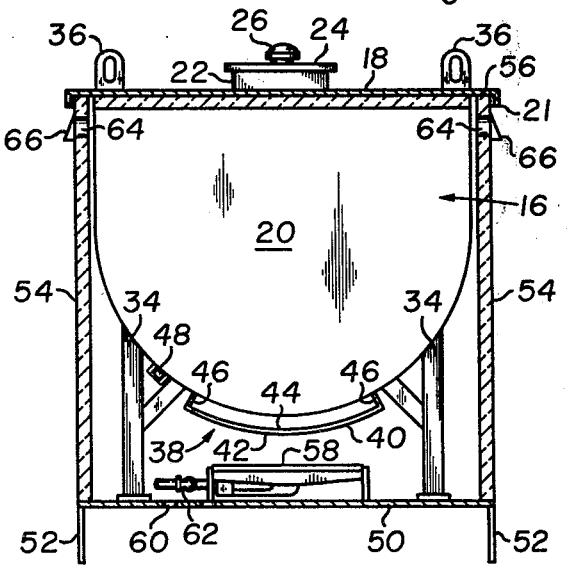
FIG. 5 is an end view of the apparatus of FIG. 1 taken along the lines 5—5 of FIG. 4.

The surfaces 40 are each provided with opposed respective heat absorbing and transmitting faces 42 and 44 which may be substantially flat and planar as seen in the drawing of FIG. 5 or may assume some other configuration or design such as arcuate or corrugated. The heat transmitting or radiating faces 44 are arranged confrontingly opposite the container wall 20 to enable the transfer of heat from the member 38 to the container 16 in a manner to be described hereinafter while the absorbing faces 42 are disposed in the opposite direction outwardly from the container wall 20.

The heat absorbing members 38 may be fabricated of a mild steel having a thickness in the range of 0.06 to 0.375 inches, and preferably 0.125 inches. The surface 40, in the embodiment shown and herein described, is preferably 4 inches in width by 24½ inches in length, although it is contemplated that the width may be within the range of 2 to 6 inches. The selected spacing between the transmitting face 44 and the container wall 20 should be in the range of 0.5 to 2 inches, the preferred spacing being 0.75 to 1.25 inches.

The surfaces 40 are supportably connected to the container wall 20 as by welding at legs 46 depending from the surfaces 40. The legs or supports 46 may be fabricated integral with the surface 40 by suitably bending the end portions thereof to form an elongated substantially U-shaped member 38 and thus provide a selective spacing of the surface 40 from the wall 20. It should be understood, however, that the provision of the depending legs 46 for supportably spacing the radiating elements 40 from the container wall 20 is by way of example only and is not meant to constitute a limitation on the particular configuration or structure of the members 38 or on the manner of supporting the same relatively spaced from the container 16. Likewise, it is within the contemplation of the invention that the positioning of the absorbing members 38 relative to the container wall 20 include means (not shown) for continuously or discretely varying the spacing between the transmitting face 44 and the confrontingly adjacent container wall 20 as desired.

Thermostatic means 48 is provided on the container 16 for sensing the temperature of the wall 20 in the area of the attached heat absorbing members 38. Preferably the thermostatic means 48 is positioned on the wall 20 at least 2 to 8 inches from the ends of the absorber means 38.

The heating apparatus 14 includes a base 50 having depending supports 52 for maintaining the base 50 supported off the ground surface and carrying an upstanding insulating wall 54 provided with a rim 56 at the top thereof. The base 50 and vertical insulating wall 54 of the heating apparatus 14 are arranged to extend completely about the container 16 when the tar pot 12 is operationally positioned relative to the heating apparatus 14 as will be described.

A heating means or source of heat comprising a plurality of elongated heaters 58 is provided on the base 50, the strip heaters 58 being positioned substantially transverse to the elongation of the base 50 in the same manner that the heat absorbing members 38 are mounted transverse to the elongation of the container wall 20. A plurality of air admitting passages 60 are defined in the base 50 adjacently below the heaters 58 so that a sufficient supply of oxygen from the external ambient atmosphere may be drawn into the interior of the heating apparatus 14 to enable combustion to occur in the heaters 58 positioned therein.

The heaters 58 preferably emit infrared radiation at a temperature in the range of 1,500° to 1,700° F., and preferably approximately 1,600° F., and may consist of standard propane gas strip heaters overlayed with infrared emitting screens or grids. A gas line 62 is utilized to channel a supply of propane gas to the heaters 58 for combustion. As will become clear as this description proceeds, the use of infrared heat, as distinguished from direct flame or convection heating, is important in the preset invention because it enables a reasonably large concentration of heat to be directed toward the container 16 without, however, pinpointing the heat to any specific spot thereon which might tend to result in overheating and "coking" of the tar in the container at such spot.

The heating apparatus 14 is further provided with a plurality of outlet vents 64 that facilitate and encourage the venting to the atmosphere of whatever minimal byproducts of combustion tend to build up or accumulate in the enclosure. Thus, a flow of air is afforded from between the passages 60, below the heaters 58, to and through the vents 64 to assure a continuous supply of combustion air to the heaters and the exhaust of the byproducts of such combustion. The vents 64 are advantageously located on the upper portion of the continuous sidewall 20 proximate the rim 56 and may be covered with downwardly depending hoods 66 to substantially prevent the admission of foreign or contaminating substances such as dirt or rain water or liquid asphalt through the vents 64 and into the interior of the heating apparatus 12.

Figure 4:
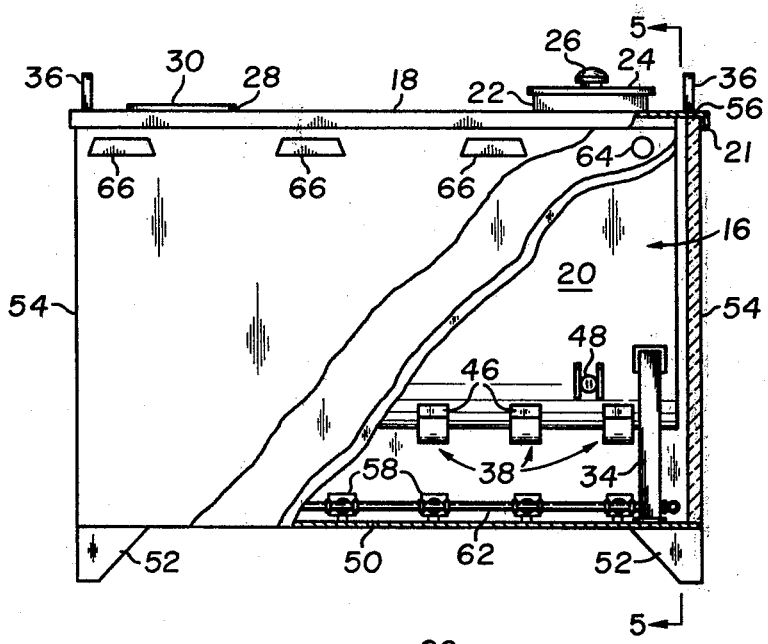
FIG. 4 is a side view, partially broken away, of the apparatus of FIG. 1.

In use, the asphalt-containing tar pot 12 is lifted as with the transporting loops 36 and lowered into a position of supported engagement within the heating apparatus 14. As seen in FIGS. 1, 4 and 5, the legs 34 on the tar pot 12 are adapted to rest on the heating apparatus base 50 to provide sufficient support for the material-holding container 16. The length of the legs 34 is selected for a flush fit of the container cover 18 atop the insulating wall rim 56 so as to provide added support for the container 16 and to substantially complete a peripheral enclosure defined about the container 16 and bounded by the heating apparatus base 50 and vented insulating wall 54. The marginal edges 21 depending from the cover 18 depend downwardly over the top of the wall 54 of the heating apparatus 14 to assure that liquid asphalt inadvertently dropped or spilled on or about the apparatus 10 may not enter into the interior of the heating apparatus 14.

It can, therefore, be appreciated that the tar pot assembly 12 is easily positioned for and removed from supported engagement with the heating apparatus 14 such that the same tar pot 12 may be utilized with a plurality of different heating apparatuses 14 in various locations. Likewise, the tar pot 12 may be removed to a remote site for refilling with from a supply of liquid asphalt when its initial contents have been exhausted while a second asphalt-containing tar pot 12 kept on hand at the operating site for this purpose may be positioned supportedly within the same heating apparatus 14 to enable a continuous and substantially uninterrupted supply.

As will now become clear, there is a one to one correspondence in the inventive apparatus 10 in the number of strip heaters 58 and heat absorbing members 38. Moreover, the arrangement of the heaters 58 on the base 50 and of the absorbing members 38 on the container wall 20 is such that when the tar pot 12 is supportedly positioned on the heating apparatus 14, the infrared heat or radiation emitted by the heaters 58 is directed toward and impinges upon the absorbing faces 42 of the heat absorbing members 38 and not directly upon the container wall 20. That is, each of the heaters 58 is positioned in substantial registration with a corresponding one of the radiating elements or surfaces 40 such that the absorbing face 42 thereof intercepts the emitted infrared radiation or heat and prevents its direct impingement on the container wall 20.

Toward this end, it is preferred that each of the infrared heaters 58 emits infrared radiation in the direction of a corresponding absorbing member 38 over an area of 2 inches by 20½ inches. Inasmuch as this area of infrared emission is smaller than the preferred area for radiation impingement of each of the heat absorbing faces 42, it can be appreciated that the likelihood of infrared radiation impinging directly upon the container 16 rather than being intercepted or blocked by the heat absorbing member 38 is substantially lessened or reduced. It has in addition been found that a distance or spacing between the infrared heaters 58 and the absorbing faces 42 in the range of 3 to 6 inches yields acceptable results, with the preferred spacing being 4 to 5 inches.

Thus, the heaters 58 emit a concentrated infrared radiation directed onto the absorbing faces 42 of the heat absorbing members 38. The distance that the infrared rays must travel results in a diminution of the heat that the rays will apply to the absorbing faces 42 and the members 38 are, consequently, heated to a temperature of approximately 650° to 700° F. which is substantially less than the preferred emission temperature of 1600° F. This temperature elevation of the absorbing members 38 causes them to emit secondary radiation or heat from their transmitting faces 44 directed toward the confrontingly opposed container wall 20 spaced therefrom. The application of the secondary radiation onto the container wall 20 causes the same to be heated in the area of heat impingement to a temperature of approximately 450° F., which is sufficiently below the decomposition temperature of the asphalt (approximately 550° to 575° F.) as to prevent it from coking. Such temperature is, however, sufficiently above the melting temperature of the asphalt to maintain the same in a molten or flowable state for use. Thus, the spacing between the heat absorbing members 38 and the container 18 is similarly utilized to enable a further desired loss of heat therebetween such that only a portion of the radiation directly applied to the members 38 by the heaters 58 reaches the container wall 20.

As a consequence, a substantially continuous low temperature heat may be applied to the container 18 utilizing a relatively high temperature heat source. The absorbing members 38 intercept the high temperature infrared heat from the source and absorb a desired amount or portion of the same and transmit to the skin of the container a relatively lower temperature heat such that the tar within the container 18 is not permitted to coke, even with substantially continuous heating over extended periods of time. The secondary radiation or heat is applied to the surface of the container wall 20 over a larger area and more diffusely than the infrared radiation from the heaters 38 impinges upon the absorbing members 38, thereby substantially avoiding the creation of localized superheated areas or hot spots on the container wall 20. This diffusion has the further effect of lengthening the useful life of the tar pot 12 since the relatively high temperature radiation from the heaters 58 directly impinges not upon the container wall 20 but instead upon the absorbing members 38. The absorbing members 38 are far more easily and economically replaced than providing a new container 16 or complete tar pot 12.

The heat produced within the enclosure by the operation of the heat source and that dissipated by the absorbing members 38 is convectively caused to flow upwardly and about all of the sides of the container 16 substantially evenly about the skin surface thereof. Such flow facilitates an essentially even heating of the container 16 fully about its outer surface as the rising heat conductively transfers thermal energy to the container skin. The convective flow within the peripheral enclosure which permits the air to pass outwardly of the heating apparatus 14 also serves to rid the peripheral enclosure defined between the container 16 and the insulating wall 54 of the heating apparatus 14 of whatever noxious and/or polluting products of combustion may tend to settle and accumulate therein as a result of the operation of the apparatus 10.

To further insure against overheating of the contained asphalt material, the thermostatic means 48 monitors the temperature of the container wall 20. The thermostatic means 48 is connected with the heaters 58 for controlling their operation, as by operating a valve inserted in the gas line 62 for controlling the flow of propane gas to the heaters 58. When the temperature of the container wall 20 reaches the setting of the thermostatic means 48, which may preferably be approximately 425° F., the supply of propane gas to the heat source can automatically be temporarily discontinued or at least diminished to reduce the infrared radiation emitted by the heaters 58 so as to lower the heat applied to the absorbing members 38 and, thus, decrease the heat reaching the container wall 20.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In an apparatus for heating and maintaining an asphalt material in a molten state at temperatures within a preselected range below the decomposition temperature of the asphalt material, a container for holding an amount of the asphalt material in its molten state, infrared heating means for emitting infrared radiation at a first temperature above the asphalt material decomposition temperature, said heating means being spaced from a portion of the wall of the container such that the emitted infrared radiation is directed at said container wall portion, and heat absorbing means relatively spaced from said infrared heating means and said container wall portion and interposed therebetween to receive infrared radiation emitted by the heating means to prevent the emitted radiation from impinging directly upon the container wall, said heat absorbing means being heated to a second temperature less than said first temperature and greater than the preselected temperature range by absorption of the infrared radiation impinging thereon and emitting secondary radiation at said second temperature onto said container wall portion, the relative spacings between said heating means and absorbing means and said absorbing means and container wall portion being so selected as to cause the secondary radiation to impinge upon said container wall portion at a third temperature less than said second temperature and within the preselected range so as to maintain the temperature of the asphalt material in contact with the container wall portion within the preselected range below the decomposition temperature of the asphalt material, said heat absorbing means being inperforate and being between said heating means and container wall so as to intercept the infrared radiation emitted by said heating means to prevent the same from impinging directly upon said container wall and to convert the heat of sad infrared radiation to a lower heat intensity by absorbing certain of said heat of said heating means and to serve as a selective regulating control of the heat acting upon said container wall.

2. In an apparatus according to claim 1, said heat absorbing means comprising a plurality of heat absorbing members each having a surface and support means on said surface for retaining the surface spaced from the container wall in substantially parallel relation thereto, each of said surfaces absorbing infrared radiation from said heating means on one face thereof and emitting secondary radiation from an oppositely disposed face confrontingly opposing said container wall.

3. In an apparatus according to claim 2, each of said absorbing member surfaces emitting secondary radiation onto said container wall over a larger area than the area of said surface upon which infrared radiation impinges from said heating means.

4. In an apparatus according to claim 3, thermostatic means on said container wall for sensing the temperature of the same and for controlling the operation of said heating means so as to insure that said container wall is maintained at a temperature below the decomposition temperature of the asphalt material.

5. In an apparatus according to claim 4,
an outer enclosure about said heating means and at least said container wall portion, said outer enclosure having outlet means defined therein to facilitate the venting of air from within said enclosure as a result of the operation of said heating means to an atmosphere outside of the enclosure.

6. In an apparatus according to claim 5,
said container having substantially closed and having a closable access opening in said container for the introduction of molten asphalt material into the same and breather means on said container to enable the release of gases that accumulate and build up pressure therewithin.

7. In an apparatus according to claim 1,
said first temperature being in the range of 1500° to 1700° F. and preferably being approximately 1600° F.

8. In an apparatus for maintaining a flowable material bstantially at a preselected temperature,
a vessel for holding the material,
infrared heating means spaced from the vessel for emitting infrared radiation at a first temperature greater than the preselected temperature,
and absorber means relatively spaced from said vessel and heating means and interposed therebetween for intercepting the infrared radiation emitted by the heating means so as to substantially prevent impingement of the infrared radiation directly upon said vessel, said absorber means being heated by the intercepted infrared radiation and emitting secondary radiation onto said vessel for heating the same to the preselected temperature to enable a conductive transfer of heat from the vessel to the material therein sufficient to maintain the material substantially at the preselected temperature, said heat absorbing means being imperforate and being between said heating means and container wall so as to intercept the infrared radiation emitted by said heating means to prevent the same from impinging directly upon said container wall and to convert the heat of said infrared radiation to a lower heat intensity by absorbing certain of said heat of said heating means and to serve as a selective regulating control of the heat acting upon said container wall.

9. In an apparatus according to claim 8,
said absorber means having opposed faces, one of which receives the infrared radiation from said heating means and the other of which transmits the secondary radiation to said vessel, said one face being selectively spaced from said heating means and said other face being selectively spaced from said vessel, the selection of the relative spacings between said absorber means and each of said heating means and vessel being such as to cause the secondary radiation to impinge upon said vessel at a temperature less than the first temperature at which the infrared radiation is emitted and substantially at the preselected temperature to prevent the heating of the vessel to temperatures substantially above the preselected temperature at which decomposition of the material in said vessel may take place.

10. In an apparatus according to claim 9,
said absorber means comprising a plurality of radiating elements each having opposed faces,
and said heating means comprising a plurality of infrared heaters,
each of said radiating elements being operatively arranged in cooperative registration with a corresponding one of said plural heaters for intercepting the infrared radiation emitted thereby.

11. In an apparatus according to claim 9,
said vessel being substantially closed and having a bottom portion upon which the secondary radiation is directed by said absorber means, a cover and sidewalls connecting said bottom portion and said cover.

12. In an apparatus according to claim 11,
an outer container defining a peripheral enclosure about said heating means and said vessel bottom portion and sidewalls, said outer container having venting means on the container proximate the vessel cover to provide an outlet to the exterior for encouraging the passage of air through said enclosure and such that heat is forced to rise along the sidewalls of the vessel to said venting means for escape to the exterior, the heat conductively transferring thermal energy to said sidewalls as it rises along the same so as to effect auxiliary heating of the sidewalls and facilitate the maintenance of said vessel at a substantially uniform temperature throughout.

13. In an apparatus according to claim 9,
said first temperature at which the infrared radiation is emitted being in the range of 1500° to 1700° F. and the preselected temperature being preferably approximately but not more than 450° F.

14. In an apparatus according to claim 13,
the spacing between said heating means and absorber means being in the range of 3 to 6 inches and preferably 4 to 5 inches, and the spacing between said absorber means and vessel being 0.5 to 2 inches and preferably 0.75 to 1.25 inches.

15. In an apparatus according to claim 14,
said absorber means including a surface carrying said opposed faces, the thickness of said surface between said opposed faces being in the range of 0.06 to 0.375 inches, and preferably being 0.125 inches.

16. In an apparatus for heating a container from a high temperature source of heat and for maintaining the temperature of the container at a substantially constant preselected temperature less than the temperature of the heat source,
a heater for emitting infrared radiation at a temperature in the range of 1500° to 1700° F. and preferably approximately 1600° F.,
a container to be heated substantially to a temperature of approximately 450° F.,
an absorber of a thickness selected in the range of 0.06 to 0.375 inches and preferably 0.125 inches interposed between said heater and container for intercepting the infrared radiation emitted by said heater to prevent the direct impingement of the infrared radiation upon said container and for heating said absorber to a temperature substantially in the range of 650° to 700° F. by absorption of the infrared radiation so as to cause said absorber to emit secondary radiation onto said container, said absorber being spaced from said heater to a selected distance of 3 to 6 inches and preferably 4 to 5 inches and spaced from said container to a selected distance of 0.5 to 2 inches and preferably 0.75 to 1.25 inches, said heat absorbing means being imperforate and being between said heating means and container wall so as to intercept the infrared radiation emitted by said heating means to prevent the same from impinging directly upon said container wall and to convert the heat of said infrared radiation to a lower heat intensity by absorbing certain of said heat of said heating means and to serve as a selective regulating control of the heat acting upon said container wall, and thermostatic means on said container for sensing the temperature of the container and connected with said heater to control the operation thereof, said thermostatic means being spaced from the area of impingement of the second radiation thereon a distance selected in the range of 2 to 8 inches.

17. In an apparatus for heating a body from a heat source emitting infrared radiation at a first temperature wherein it is desired to maintain the body substantially at and no higher than a second temperature less than the first temperature, the heat source being spaced from the body a fixed distance such that the temperature of the infrared radiation is sufficiently reduced in traversing the fixed distance to cause its impingement on the body at a temperature no higher than the second temperature, means for controllably increasing the temperature loss of the emitted infrared radiation in traversing the fixed distance without increasing the fixed distance comprising:

absorbing and transmitting means interposed between the heat source and the body for absorbing the infrared radiation emitted by the source so as to prevent the infrared radiation from impinging directly upon the body, said means being heated to a third temperature less than the first temperature and greater than the second temperature, and for emitting secondary radiation at the third temperature onto the body to heat the same to the second temperature, said absorbing and transmitting means being relatively spaced from the heat source and the body by amounts so selected as to provide a predetermined heat loss between the heat source and the body, the predetermined heat loss being greater than that normally occurring over the fixed distance when the emitted infrared radiation at the first temperature is permitted to impinge directly upon the body, said heat absorbing means being imperforate and being between said heating means and container wall so as to intercept the infrared radiation emitted by said heating means to prevent the same from impinging directly upon said container wall and to convert the heat of said infrared radiation to a lower heat intensity by absorbing certain of said heat of said heating means and to serve as a selective regulating control of the heat acting upon said container wall.

* * * * *

UNITED STATES PATENT AND TRADEMARK OFFICE

CERTIFICATE OF CORRECTION

PATENT NO. : 4,192,288

DATED : March 11, 1980

INVENTOR(S) : ANTON H. HELLER

It is certified that error appears in the above-identified patent and that said Letters Patent are hereby corrected as shown below:

IN THE CLAIMS:

Claim 6, line 2, change "having substantially" to --being substantially--

Claim 8, line 2, change "bstantially" to --substantially--

Claim 16, line 39, change "second" to --secondary--

Signed and Sealed this

*Seventeenth* Day of *June 1980*

[SEAL]

*Attest:*

SIDNEY A. DIAMOND

*Attesting Officer*

*Commissioner of Patents and Trademarks*